US008443494B2

(12) United States Patent
Sharp

(10) Patent No.: US 8,443,494 B2
(45) Date of Patent: May 21, 2013

(54) SYSTEM FOR MAGNETICALLY CINCHING CLOTHING TO A USER

(75) Inventor: Kimberly Jo Sharp, Riverside, CA (US)

(73) Assignee: T&B Industries, Yorba Linda, CA (US)

( * ) Notice: Subject to any disclaimer, the term of this patent is extended or adjusted under 35 U.S.C. 154(b) by 283 days.

(21) Appl. No.: 12/899,046

(22) Filed: Oct. 6, 2010

(65) Prior Publication Data

US 2011/0083303 A1 Apr. 14, 2011

Related U.S. Application Data

(60) Provisional application No. 61/249,153, filed on Oct. 6, 2009.

(51) Int. Cl.
*A44B 99/00* (2010.01)

(52) U.S. Cl.
USPC ..... 24/303; 24/3.12

(58) Field of Classification Search ..... 24/303, 24/3.1, 3.12, DIG. 26, 460–462, 72.5, 454, 24/326, 30.5 R, 571, 570, 910, 66.9; 396/652
See application file for complete search history.

(56) References Cited

U.S. PATENT DOCUMENTS

| | | | | | |
|---|---|---|---|---|---|
| 579,601 | A | * | 3/1897 | Neuenschwander | 269/2 |
| 642,236 | A | * | 1/1900 | Larimer | 24/3.12 |
| 2,066,732 | A | * | 1/1937 | Kunz | 396/652 |
| 3,141,221 | A | * | 7/1964 | Faulls, Jr. | 24/30.5 R |
| 3,629,905 | A | * | 12/1971 | Cote | 24/30.5 R |
| D277,436 | S | | 2/1985 | Benedict | |
| 5,347,671 | A | * | 9/1994 | Hunts | 7/156 |
| D382,717 | S | | 8/1997 | Rolnick et al. | |
| 5,752,297 | A | * | 5/1998 | Ramey | 24/462 |
| D398,160 | S | | 9/1998 | Umbarger | |
| D411,372 | S | | 6/1999 | Woodring | |
| D444,954 | S | | 7/2001 | Umbarger | |
| D457,331 | S | | 5/2002 | Pinchuk | |
| D469,262 | S | | 1/2003 | Umbarger | |
| 6,517,022 | B1 | * | 2/2003 | Bailey | 242/388.1 |
| D509,669 | S | | 9/2005 | Krebs | |
| 6,971,147 | B2 | * | 12/2005 | Halstead | 24/303 |
| D533,360 | S | | 12/2006 | Chan | |
| D541,536 | S | | 5/2007 | Christianson | |
| 7,721,396 | B2 | * | 5/2010 | Fleischman | 24/460 |
| D621,625 | S | | 8/2010 | Sharp | |

OTHER PUBLICATIONS

"U.S. Appl. No. 29/344,938, Notice of Allowance mailed Apr. 6, 2010", 6 pgs.

* cited by examiner

*Primary Examiner* — Robert J Sandy
*Assistant Examiner* — Abigail E Morrell
(74) *Attorney, Agent, or Firm* — Schwegman Lundberg & Woessner, P.A.

(57) ABSTRACT

One embodiment of a system includes a backing bar extending a bar length between a first bar end and a second bar end, the bar having an aperture disposed through the bar, with the aperture located between the first end and the second end, the aperture sized to pass a portion of clothing a first magnet coupled to the backing bar proximal the first end a second magnet coupled to the backing bar proximal the second end and an elongate concave bar receiving member extending along a receiving member length that is approximately as long as the bar length, the receiving member length extending between a first receiver end and a second receiver end, with the receiving member being magnetic proximal the first receiver end and the second receiver end, the receiver to receive the backing bar to pinch clothing extending through the aperture between the backing bar and the receiving member.

8 Claims, 6 Drawing Sheets

SYSTEM FOR MAGNETICALLY CINCHING CLOTHING TO A USER

CROSS-REFERENCE TO RELATED PATENT DOCUMENTS

This patent application claims the benefit of priority, under 35 U.S.C. §119(e), to U.S. Provisional Patent Application Ser. No. 61/249,153, filed on Oct. 6, 2009, which is incorporated herein by reference in its entirety.

This patent application is also related to U.S. Design patent application Ser. No. 29/344,938, filed Oct. 6, 2009 and issued on Aug. 17, 2010 as U.S. Design Pat. No. D621,625, which is incorporated herein by reference in its entirety.

TECHNICAL FIELD

This document relates generally to magnetic clips, and more specifically, to a method and apparatus for a magnetic clip to cinch clothing to a user.

BACKGROUND

Clothing can fit loosely, which can be aesthetically unappealing, and which can leave clothing free to flow and fall into undesirable locations. For example, loose clothing can tumble away from a wearer and become stuck in machinery. There are a number of solutions that have been applied to address these problems, such as elastic bands, belt, zippers, pins and other devices. However, these devices are not always aesthetically appealing, and often they're not compatible with many types of clothes. For example, if one has a loose t-shirt, one cannot easily apply an elastic band, belt or zipper to cinch it around a user. If one uses a pin, one must operate that pin, which can result in pricked fingers and which often is not aesthetically appealing. What is needed is a method and apparatus to fulfill these needs.

OVERVIEW

One embodiment of a system includes a backing bar extending a bar length between a first bar end and a second bar end, the bar having an aperture disposed through the bar, with the aperture located between the first end and the second end, the aperture sized to pass a portion of clothing a first magnet coupled to the backing bar proximal the first end a second magnet coupled to the backing bar proximal the second end and an elongate concave bar receiving member extending along a receiving member length that is approximately as long as the bar length, the receiving member length extending between a first receiver end and a second receiver end, with the receiving member being magnetic proximal the first receiver end and the second receiver end, the receiver to receive the backing bar to pinch clothing extending through the aperture between the backing bar and the receiving member.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
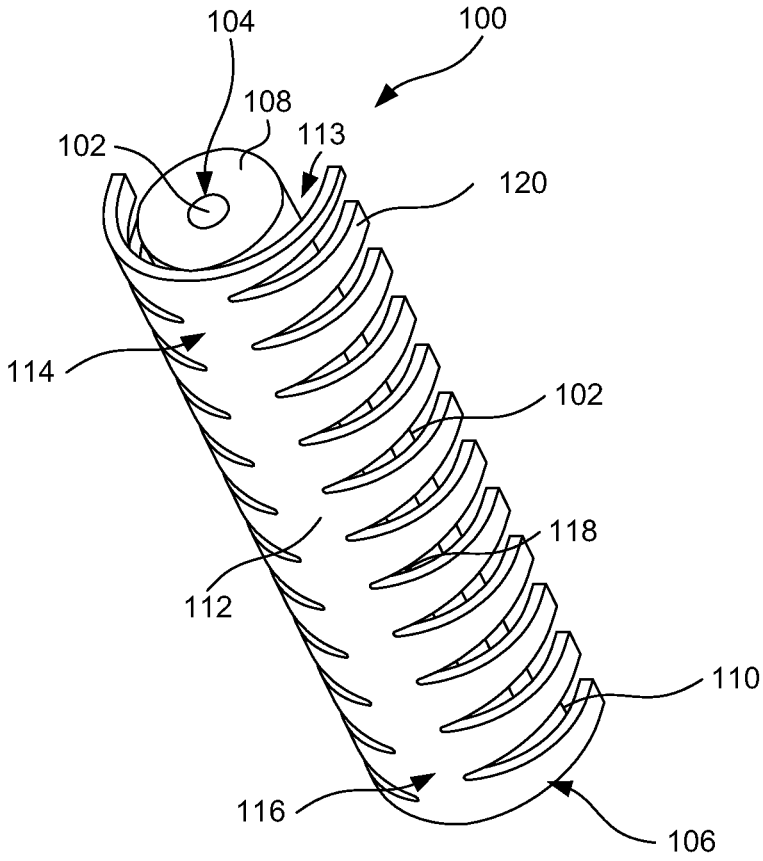
FIG. 1 shows a perspective view of a clip system, according to some embodiments.

FIG. 1 shows a perspective view of a clip system 100, according to some embodiments. The clip system 100 shows a backing bar 102 extending a bar length "L" (see e.g., FIG. 5) between a first bar end 104 and a second bar end 106. Various embodiments include a first magnet 108 coupled to the backing bar proximal the first end 104. Various embodiments also include a second magnet 110 coupled to the backing bar proximal the second end 106.

The bar is magnetically attracted to an elongate concave bar receiving member 112. In various embodiments, the bar receiving member 112 has a cavity 113 to receive the bar 102. In various embodiments, the bar receiving member 112 is long enough to provide a magnetic area of attraction 114 for the first magnet 108 and a second magnetic area of attraction 116 to attract the second magnet 110.

An aperture 118 is defined by the bar 102. In various embodiments, a user inserts cloth through the aperture 118 and then affixes the bar into the cavity 113 of the bar receiving member 112 to pinch the fabric. In some embodiments, the fabric may be rolled around the bar 102 before the bar 102 is fastened to the bar receiving member 112. In this manner, one may cinch the fabric around an object or person. In some embodiments, teeth 120 help to grab the material and to provide a relief for the material so that the magnets 108 and 110 can be positioned functionally close to the bar receiving member 112.

Figure 2:
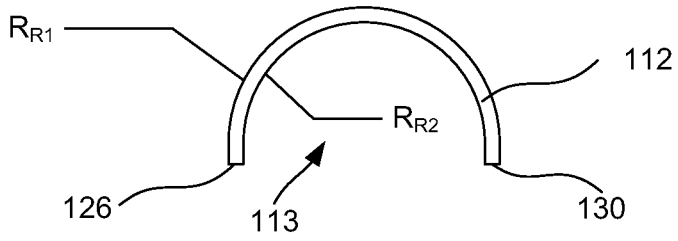
FIG. 2 shows a top view of a bar receiving member, according to some embodiments.

FIG. 2 shows a top view of a bar receiving member 112, according to some embodiments. The receiving member 112 has a C-shape or half-circle shape, in various embodiments. The present subject matter is not so limited, however, and other shapes are possible. For example, in some embodiments, magnets 108, 110 having a cross section other than a circle or ellipse in a plane defined by a depth "D" and a width "W" (see e.g., FIGS. 5-6, hereinafter the W×D plane) are used, and in those embodiments, the receiving member 112 includes a similar shaped cavity 113 or void sized to receive the mating magnet. Magnets having a rectangular cross section in the W×D plane are contemplated. In those embodiments, the receiving member 112 would have a shape that resembled one half cross-section of a rectangular box. Other shapes are possible.

Figure 3:
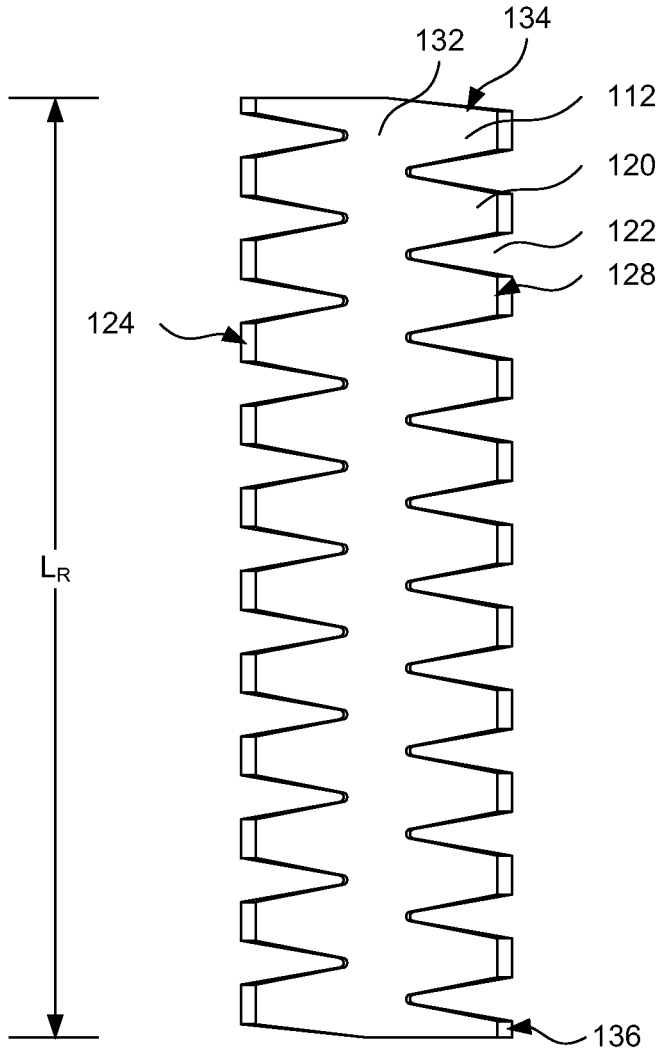
FIG. 3 shows a back view of a bar receiving member, according to some embodiments.

FIG. 3 shows a back view of a bar receiving member 112, according to some embodiments. The teeth 120 can be any shape that allows the teeth 120 to define a series of comb-drums 122. As such, some embodiments resemble a first comb 124 extending along a first lengthwise edge 126 on one side of the receiving member 112, and a second comb 128 opposing the first comb 124, the second comb 128 extending along a second lengthwise edge 130 on an opposite side of the receiving member 112, with the first 124 and second 128 combs sharing a common comb spine 132. Other numbers of teeth are possible, and the present subject matter is not limited to embodiments having teeth, nor is it limited to embodiments being symmetrical or having teeth on each edge. Teeth that are rounded or chamfered on one or more edges can be used.

In various embodiments, the receiving member 112 extends along a receiving member length $L_R$ that is approximately as long as the bar length L. In various embodiments, the receiving member length $L_R$ extends between a first receiver end 134 and a second receiver end 136. In various embodiments, the length $L_R$ is approximately 75.91 millimeters, but other sizes are possible. In various embodiments, the radius $R_{R1}$ is approximately 10.99 millimeters, and the radius $R_{R2}$ is approximately 9.72 millimeters, but the present subject matter extends to other sizes.

In various embodiments, the receiving member 112 is magnetic proximal the first receiver end 134 and the second receiver end 136. Magnetism may be provided by, but is not limited to, the adhesion of magnetic material such as steel to a substrate of the receiving member 112, via doping material that forms the receiving member 112, and by over-molding material of the receiving member 112 over a magnetic structure. The receiving member 112 can be formed of any material that provides for such magnetism such as a doped polymeric material, metal or combinations thereof. In various embodiments, the receiving member 112 is to receive the backing bar 102 to pinch clothing extending through the aperture 118 between the backing bar 102 and the receiving member 112.

Figure 6:
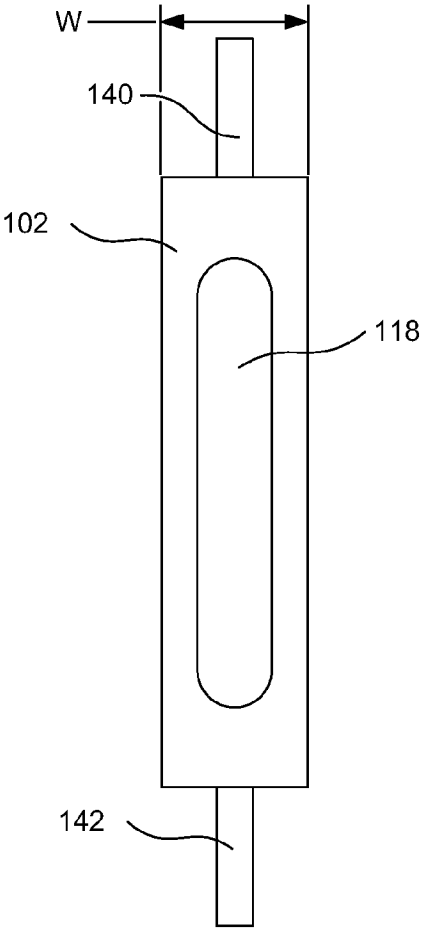
FIG. 6 shows a front view of a backing bar without magnets, according to some embodiments.
Figure 5:
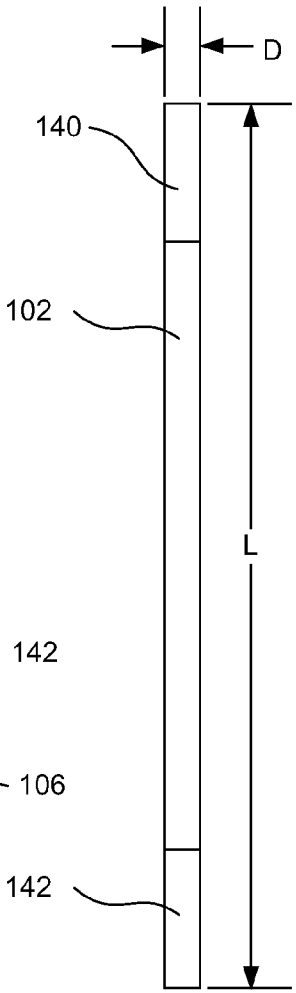
FIG. 5 shows a right side view of a backing bar without magnets, according to some embodiments.
Figure 4:
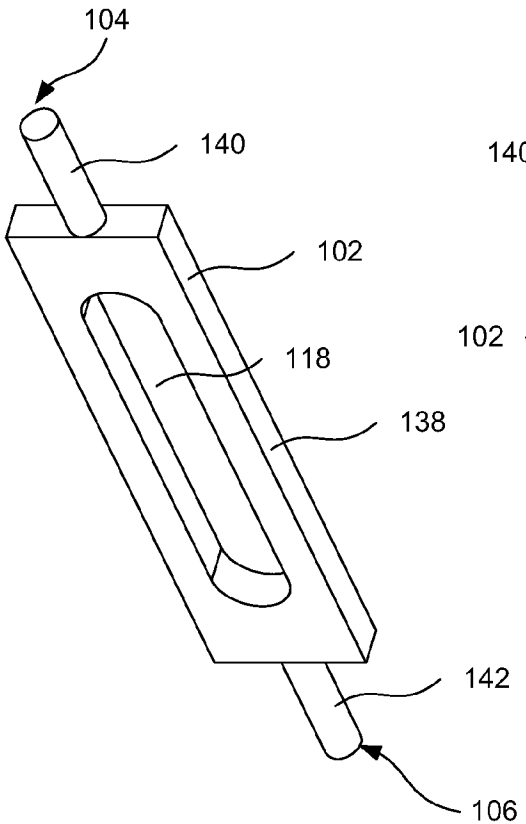
FIG. 4 shows a perspective view of a backing bar without magnets, according to some embodiments.

FIG. 4 shows a perspective view of a backing bar without magnets, according to some embodiments. FIG. 5 shows a right side view of a backing bar without magnets, according to some embodiments. FIG. 6 shows a front view of a backing bar without magnets, according to some embodiments. The backing bar 102 defines an aperture 118. The backing bar includes a rectangular center portion 138 that is rectangular in the W×D plane and the L×D plane, with the aperture 118 extending through the rectangular center portion through the L×W plane in the direction of D.

Various embodiments include a first dowel 140 and a second dowel 142 coupled to the rectangular center portion 138. In various embodiments, the first 140 and second 142 dowels are monolithic with the center portion 138, being formed of the same material. Materials contemplated include, but are not limited to, polymers, metals and combinations thereof. In some embodiments, the receiving member 112 is magnetic, and one or both of the dowels are magnetic. In some embodiments, both the dowels 140, 142 and the receiving member 112 are magnetic polar opposites. The dowels can be magnets, doped with magnets, including magnetic or ferromagnetic dopant, or can be formed with or coupled with magnets or ferromagnetic material.

In some embodiments, the length L is 73.7 millimeters, the depth D is 3.0 millimeters, and the width W is 12.19 millimeters, but the present subject matter is not so limited. In various embodiments, the backing bar 102 has a depth D orthogonal to the bar length L, and a width W orthogonal to the depth D and the bar length L, with the bar length L greater than the width W, and with the width W greater than the depth D.

In various embodiments, the bar 102 includes an aperture 118 disposed through the bar 102, with the aperture located between the first end 104 and the second end 106, the aperture sized to pass a portion of clothing, such as a sash, scarf, t-shirt or other clothing.

In various embodiments, the entire bar 102 is dowel shaped, with an aperture extending through the dowel 102. Various embodiments include one or more detents disposed on a surface of the bar to align the bar with mating detens on receiving member 112.

Figure 8:
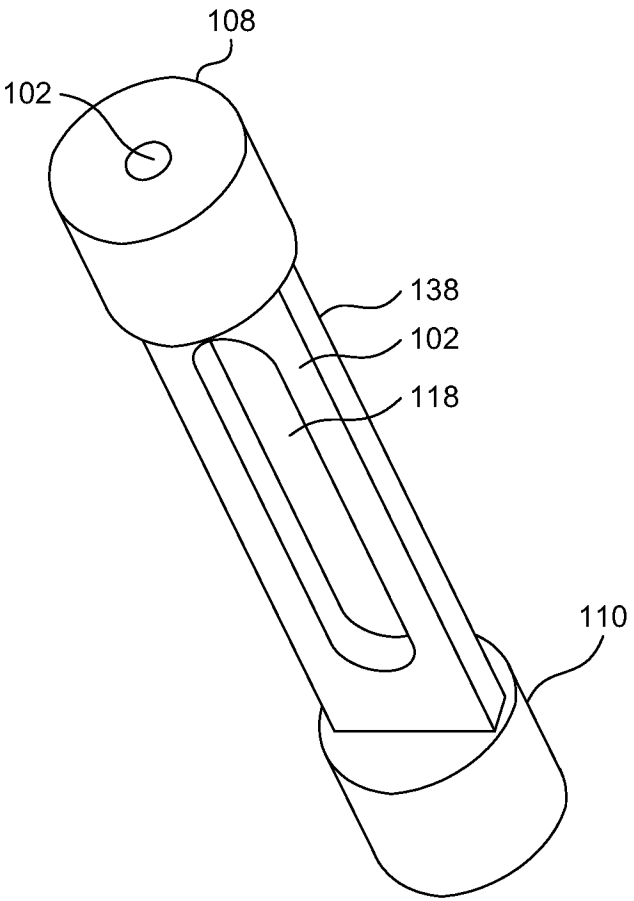
FIG. 8 shows a perspective view of a backing bar with magnets, according to some embodiments.
Figure 7:
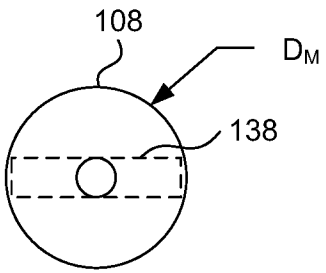
FIG. 7 shows a top view of a backing bar with magnets, according to some embodiments.

FIG. 7 shows a top view of a backing bar with magnets, according to some embodiments. FIG. 8 shows a perspective view of a backing bar with magnets, according to some embodiments. The first magnet 108 is proximal to the end 104 in that an end surface of the magnet is not necessarily coincident with the bar end 104, but is nearby. The first magnet 108 extends toward the second end 106 but not necessarily to the second end 106. In various embodiments, the first 108 and second 110 magnets each are cylindrical with a major axis parallel the length L of the bar, with the first 108 and second 110 magnets having a diameter that is greater than the width W of the bar. The magnets 108, 110 can be glued, press fit, or otherwise fixed to the bar 102.

Figure 9:
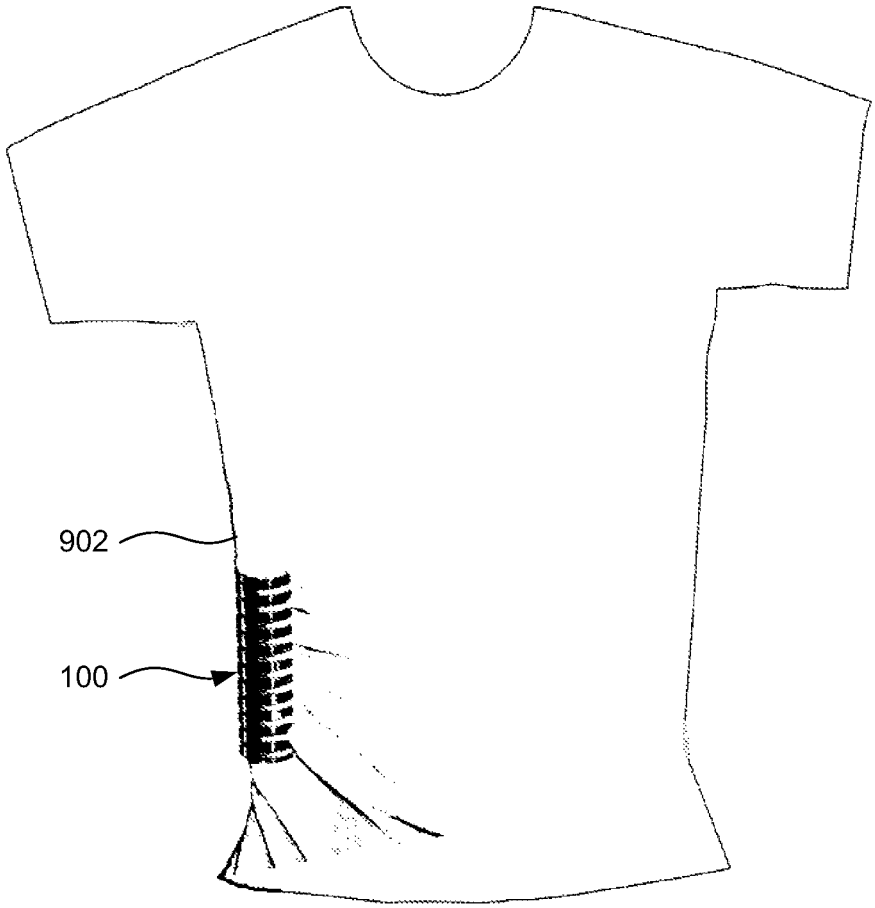
FIG. 9 shows a clothing clip and a shirt cinched by the clothing clip, according to some embodiments.
Figure 10:
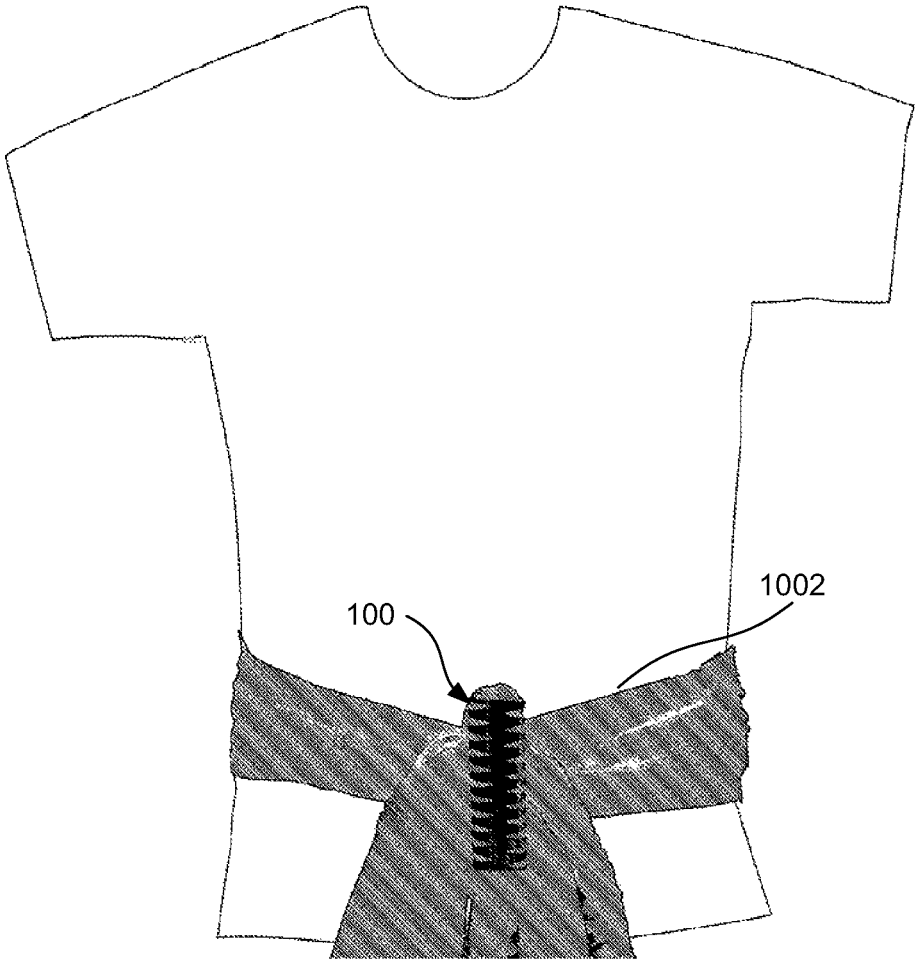
FIG. 10 shows a clothing clip clipping two ends of a scarf together, according to some embodiments.

FIG. 9 shows a clothing clip system 100 and a shirt 902 cinched by the clothing clip, according to some embodiments. FIG. 10 shows a clothing clip clipping two ends of a scarf 1002 together, according to some embodiments.

In some examples, the t-shirt and belt clip is a two-part fashion accessory. In some examples, both the bar 102 and the receiving member 112 are manufactured from stamped steel and then nickel plated. In some embodiments, the steel is SPCC grade according to the JIS G 3141 standard.

In some examples, the magnets 108 and 110 are diametrically magnetized neodymium ring magnets. In certain examples, the magnets 108, 110 are each 0.5 inch and have a 0.5 inch outside diameter and a 0.125 inch inside diameter. In some examples, the magnets 108, 110 are Grade N42 and have a pull force of 9.88 lbs each. In some examples, the magnets 108, 110 are nickel coated. In some examples, the magnets 108, 110 are attached to the bar 102 dowels with the dowels disposed inside a respective magnet inside diameter and glued with a metal adhesive.

The clip system 100 has been carefully designed as a strong multi-use fashion accessory and garment clip. The clip can be used in a variety of ways to secure and contour shirts, belts, scarves, sarongs, shawls, skirts, dresses or hair styles.

The three inch size length L of the clip is suited for most waistlines and provides a comfortable fit. The clip system 100 works with a variety of fabric weights including those less than 12 oz/yd. Material is grabbed securely through the aperture 118 on the bar 102 and can be rolled or gathered for different effects around the bar. With belts, scarves, sarongs, shawls or wrap skirts, two open ends of the garment can be feed through the aperture and pulled tightly around any area of the body. For shirts, dresses or large wrap garments where the two open ends do not meet at the desired securing location, the fabric can be pinched and threaded using the clip system 100. Once fabric is rolled or gathered on top of the bar 102 it will not be predominantly visible on the person wearing the clip, in various embodiments.

In various examples, the bar receiving member 112 is an arched half-circle that covers the fabric that has been rolled or gathered around the bar 102. The arched clip face allows for multiple layers of material to be securely clipped to the bar. When secured, optional decorative scalloped edges of the face clip create slight gathers across the garment or fabric belt to further complement most figures and add a decorative touch to any outfit.

Magnets 108, 110 have a predetermined strength to ensure a strong hold that will secure an adorned fabric tightly around the waist, hips or shoulders and will withstand regular movement, as well as heavy sports activity. For shirts, t-shirts, skirts or dresses the clip system 100 adds an element of design, while strategically contouring your garment around an object or body as desired. The clip system 100 can be used to pull garments tighter around the waist or hips, or to raise or lower garments where desired to create angles and expose skin or layered garments.

Additional Notes

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. A system, comprising:

a backing bar extending a bar length between a first bar end and a second bar end, the bar defining an aperture disposed through the bar, with the aperture located between the first end and the second end, the aperture sized to pass a portion of clothing;

a first magnet coupled to the backing bar proximal the first end;

a second magnet coupled to the backing bar proximal the second end; and an elongate concave bar receiving member extending along a receiving member length that is approximately as long as the bar length, the receiving member length extending between a first receiver end and a second receiver end, with the receiving member being magnetic proximal the first receiver end and the second receiver end, the receiving member to receive the backing bar to pinch clothing extending through the aperture between the backing bar and the receiving member.

2. The system of claim 1, wherein the backing bar includes a first end portion that is dowel shaped and that ends at the first bar end, and a second end portion that is dowel shaped and that ends at the second bar end.

3. The system of claim 1, wherein the backing bar has a depth orthogonal to the bar length, and a width orthogonal to the depth and the bar length, with the bar length greater than the width, and with the width greater than the depth.

4. The system of claim 3, wherein the first and second magnets each are cylindrical with a major axis parallel to the length of the bar, with the first and second magnets having a diameter that is greater than the width of the bar.

5. A system for cinching clothing to a user, comprising:

an elongate bar extending a bar length between a first bar end and a second bar end, the elongate bar including a center portion having a width and a height, the width of the center portion being less than the height of the center portion, the center portion defining an aperture disposed through the elongate bar along the width of the center portion, with the aperture located along the bar a first distance from the first end and a second distance from the second end, the aperture sized to pass a portion of the clothing; and an elongate bar receiving member extending along a receiving member length that is approximately as long as the bar length, the receiving member length extending between a first receiver end and a second receiver end, with the receiving member being magnetically couplable to the elongate bar, the receiving member defining a cavity that is concave in cross-section and shaped to receive the elongate bar to pinch clothing extending through the aperture between the elongate bar and the receiving member, wherein one of the elongate bar and the elongate bar receiving member is at least partially formed of magnetic material and the other of the elongate bar and the elongate bar receiving member is ferromagnetic, and wherein the width of the center portion is sized less than a width of at least one of the first bar end and the second bar end to position the elongate bar close to the elongate bar receiving member while the clothing extends through the aperture and is wrapped at least partially around the center portion of the elongate bar.

6. The system of claim 5, wherein the first distance and second distance are equal.

7. The system of claim 5, wherein the receiving member is c-shaped in cross-section along its length, the c-shape extending between a first edge and a second edge.

8. The system of claim 7, wherein at least one of the first edge and the second edge is lined with a comb.

* * * * *